US011427027B2

(12) United States Patent
Ogiwara et al.

(10) Patent No.: US 11,427,027 B2
(45) Date of Patent: Aug. 30, 2022

(54) WRITING IMPLEMENT

(71) Applicant: MITSUBISHI PENCIL COMPANY, LIMITED, Shinagawa-ku (JP)

(72) Inventors: Yasuaki Ogiwara, Shinagawa-ku (JP); Naohiko Moriya, Shinagawa-ku (JP); Toshimi Kamitani, Shinagawa-ku (JP)

(73) Assignee: MITSUBISHI PENCIL COMPANY, LIMITED, Shinagawa-ku (JP)

( * ) Notice: Subject to any disclaimer, the term of this patent is extended or adjusted under 35 U.S.C. 154(b) by 0 days.

(21) Appl. No.: 17/059,365

(22) PCT Filed: May 28, 2019

(86) PCT No.: PCT/JP2019/021022

§ 371 (c)(1),
(2) Date: Nov. 27, 2020

(87) PCT Pub. No.: WO2019/230693

PCT Pub. Date: Dec. 5, 2019

(65) Prior Publication Data

US 2021/0237502 A1 Aug. 5, 2021

(30) Foreign Application Priority Data

May 28, 2018 (JP) ..... JP2018-101513

(51) Int. Cl.
*B43K 8/04* (2006.01)
*B43K 1/00* (2006.01)
(Continued)

(52) U.S. Cl.
CPC ..... *B43K 8/04* (2013.01); *B43K 1/003* (2013.01); *B43K 3/00* (2013.01); *B43K 8/026* (2013.01); *B43K 29/003* (2013.01)

(58) Field of Classification Search
CPC ..... B43K 8/02; B43K 1/003; B43K 1/006; B43K 1/02; B43K 1/04; B43K 1/12;
(Continued)

(56) References Cited

U.S. PATENT DOCUMENTS 4,824,271 A * 4/1989 Nagahama ..... B43K 1/003 401/196
5,820,285 A * 10/1998 Ikeda ..... B43K 1/00 401/199
(Continued)

FOREIGN PATENT DOCUMENTS

DE 8716465 U1 3/1988
JP 2000-52682 A 2/2000
(Continued)

OTHER PUBLICATIONS

International Search Report dated Jul. 9, 2019 in PCT/JP2019/021022 filed on May 28, 2019, 2 pages.
Extended European Search Report issued in European Patent Application No. 19812446.3 dated Jan. 27, 2022.

*Primary Examiner* — David J Walczak
(74) *Attorney, Agent, or Firm* — Oblon, McClelland, Maier & Neustadt, L.L.P.

(57) ABSTRACT

A writing implement having a pen tip that can achieve excellent ink outflow performance and an increase in the effective area of a viewer portion allowing recognition of the writing direction, relative to the whole pen tip. The writing implement is a writing implement A which includes a pen tip 20 feeding ink from a writing implement body 10 and having a viewer portion through which the writing direction can be recognized, and is characterized in that the pen tip 20 is configured of, a least, a writing part 30 and a holding body 40 having a viewer portion 43, and the holding portion 40
(Continued)

has a sheet-shaped ink feeder 25 formed with slits or bumps on the surface and inside thereof to produce a capillary action.

2 Claims, 4 Drawing Sheets

(51) Int. Cl.
*B43K 3/00* (2006.01)
*B43K 8/02* (2006.01)
*B43K 29/00* (2006.01)

(58) Field of Classification Search
CPC ..... B43K 3/00; B43K 8/026; B43K 29/00; B43K 29/003
USPC ..... 401/194, 199, 198, 195
See application file for complete search history.

(56) References Cited

U.S. PATENT DOCUMENTS

| | | | | |
|---|---|---|---|---|
| 6,582,142 | B2 * | 6/2003 | Keller | B43K 8/024 401/11 |
| 6,659,672 | B1 | 12/2003 | Kirita | |
| 10,723,166 | B1 * | 7/2020 | Thawornsing | B43K 8/003 |

FOREIGN PATENT DOCUMENTS

| | | | |
|---|---|---|---|
| JP | 2003-291576 | A | 10/2003 |
| JP | 2006-103011 | A | 4/2006 |
| JP | 2007-69427 | A | 3/2007 |
| JP | 2017-119385 | A | 7/2017 |
| JP | 2017-144581 | A | 8/2017 |
| JP | 2017-149458 | A | 8/2017 |
| WO | WO 99/62726 | A1 | 12/1999 |

* cited by examiner (a)

(b)

WRITING IMPLEMENT

TECHNICAL FIELD

The present invention relates to a writing implement having a pen tip that allows visual recognition of the writing direction.

BACKGROUND Art

Conventionally, pen tips of writing implements, which are conventionally called paint markers, underline markers, and the like, have a wide pen core for enabling wide line drawing, have been widely used because of excellency in usability and the visibility of marking.

The pen tip of a writing implement such as a highlight marker is generally formed of a rod-like bundle of synthetic resin fibers or a porous material such as a polymer sintered body, and is given with capillarity so that ink supplied from the barrel body, or the main body of the writing implement, is lead to the pen tip to enable drawing.

With the spread of writing implements containing fluorescent ink in the barrel body that serves as the writing implement body, writing implements having various pen tip shapes and structures that enable wide line drawing have been put on the market, this offers the users a wide selection of writing implements according to their usage, bringing comfortable use.

The applicant of the present invention has disclosed a writing implement including a pen tip that can lead and hold ink supplied from an ink absorbent body (sliver) in a barrel body serving as a writing implement body, the pen tip being equipped with a viewer portion (see-through portion) allowing visual recognition of the writing direction (e.g., see Patent Document 1).

Since the pen tip of this type of writing implement can visually recognize the writing part, it is possible to stop drawing a line at a point where the user wants to stop, and hence prevent the line from being drawn excessively or sticking out. This pen tip is specifically configured of a sintered core forming an ink feeder for leading ink and a writing part, a holding body holding the sintered core and an adhesive bonding the sintered core and the holding body.

However, the pen tip of the above Patent Document 1 has a shape in which the ink feeder and the writing part are integrated, and is formed of a sintered body obtained by sintering particles of thermoplastic resin such as polyethylene with a complicated shape, so that it needs to feed ink from the ink absorbent body as far as the length of the holding body. Further, since the ink flow path is meandering, there is a problem that the ink flowability is slightly low for its porosity.

For this reason, it is necessary to design the ink feeder to be thick. However, if the ink feeder is made thick, the see-through portion is obstructed by the thick ink feeder, which gives rise to a problem, i.e., reduction of the effective area of the see-through portion compared to the whole of the pen tip.

On the other hand, as the prior art of pen tips having a visual recognition portion other than the above-mentioned structure capable of, for example, visually recognizing a writing direction, writing implements have been known as follows:

1) a writing implement having a pen tip member that is protruded from the exterior body and has a space for allowing visual recognition of the writing surface in contact therewith, arranged behind the contact portion, wherein the cross section of the ink passage behind the contact portion in contact with the writing surface is formed so as to be equal to or larger than the contact portion in contact with the writing surface (e.g., see Patent Document 2); and 2) a writing implement of an ink end detection type, in which ink absorbed in an ink absorbent body in a barrel cylinder is supplied to the pen tip serving as a writing part via an ink feed tube and the end of ink in the ink absorbent body is detected by visually observing the ink feed tube, the writing implement being characterized in that the ink feed tube has an plate-like ink feed portion with a slit-shaped ink passage of 0.01 to 1.0 mm thick while the ink feed portion allows 50% or higher of visible light to transmit when it is filled with ink, and allows visual recognition of the writing direction right under the ink feed portion with respect to the axial direction (e.g., see Patent Document 3).

However, in the writing implement described in Patent Document 2, similarly to Patent Document 1, it is necessary to thicken the ink passage in order to improve ink outflow. This, however, obstructs the viewer portion, causing a problem that the effective area of the viewer portion becomes smaller relative to the entire pen tip. In the writing implement described in Patent Document 3, the ink feed tube has an plate-like ink feed portion with a slit-shaped ink passage of 0.01 to 1.0 mm thick while the ink feed portion allows 50% or higher of visible light to transmit when it is filled with ink, and allows visual recognition of the writing direction right under the ink feed portion with respect to the axial direction. The technical concept (the configuration and its operation and effect) of this is different from the present invention.

PRIOR ART DOCUMENTS

Patent Documents

Patent Document 1:
Japanese Patent Application Laid-Open No. 2000-052682 (claims, FIG. 1, etc.)

Patent Document 2:
Japanese Patent Application Laid-Open No. 2006-103011 (claims, FIG. 1, FIG. 2)

Patent Document 3:
Japanese Patent Application Laid-Open No. 2007-69427 (claims, FIG. 1, FIG. 2, etc.)

SUMMARY OF THE INVENTION

Problems to be Solved by the Invention

The present invention has been devised in view of the above-described problems of the prior art and is intended to solve the problems. It is therefore an object of the present invention to provide a writing implement having a pen tip allowing visual recognition of the writing direction, in which the flowability of ink is secured while the effective area of a viewer portion allowing visual recognition of the writing direction relative to the entire pend tip is enlarged.

Means for Solving the Problem

The inventors hereof earnestly studied in order to solve the problem of the prior art technologies, and finally found a writing implement sufficing the above object and has completed the present invention, by providing a writing implement comprising a pen tip feeding ink from a writing implement body and having a viewer portion through which the writing direction can be recognized, with a specific configuration in the above pen tip.

Specifically, the writing implement of the present invention includes a pen tip feeding ink from a writing implement body and having a viewer portion through which the writing direction can be recognized, and is characterized in that the pen tip is configured of, a least, a writing part and a holding body having a viewer portion, and the holding portion has a sheet-shaped ink feeder formed with slits or bumps on the surface and inside thereof to produce a capillary action.

The slits or the bumps formed in the sheet-shaped ink feeder preferably have a width of 10 to 100 μm.

Further, the slits or bumps formed in the sheet-shaped ink feeder are preferably formed by a nano imprint method, a photolithography method or a laser irradiation method.

The sheet-shaped ink feeder is preferably arranged inside the peripheral end surface of the holding body.

Effect of the Invention

According to the present invention, it is possible to provide a writing implement that can achieve both excellent ink outflow performance and an increase in the effective area of the viewer portion allowing recognition of the writing direction, relative to the whole pen tip.

BEST MODE FOR CARRYING OUT THE INVENTION

Hereinafter, the embodiment of the present invention will be described in detail with reference to the drawings.

Figure 1:
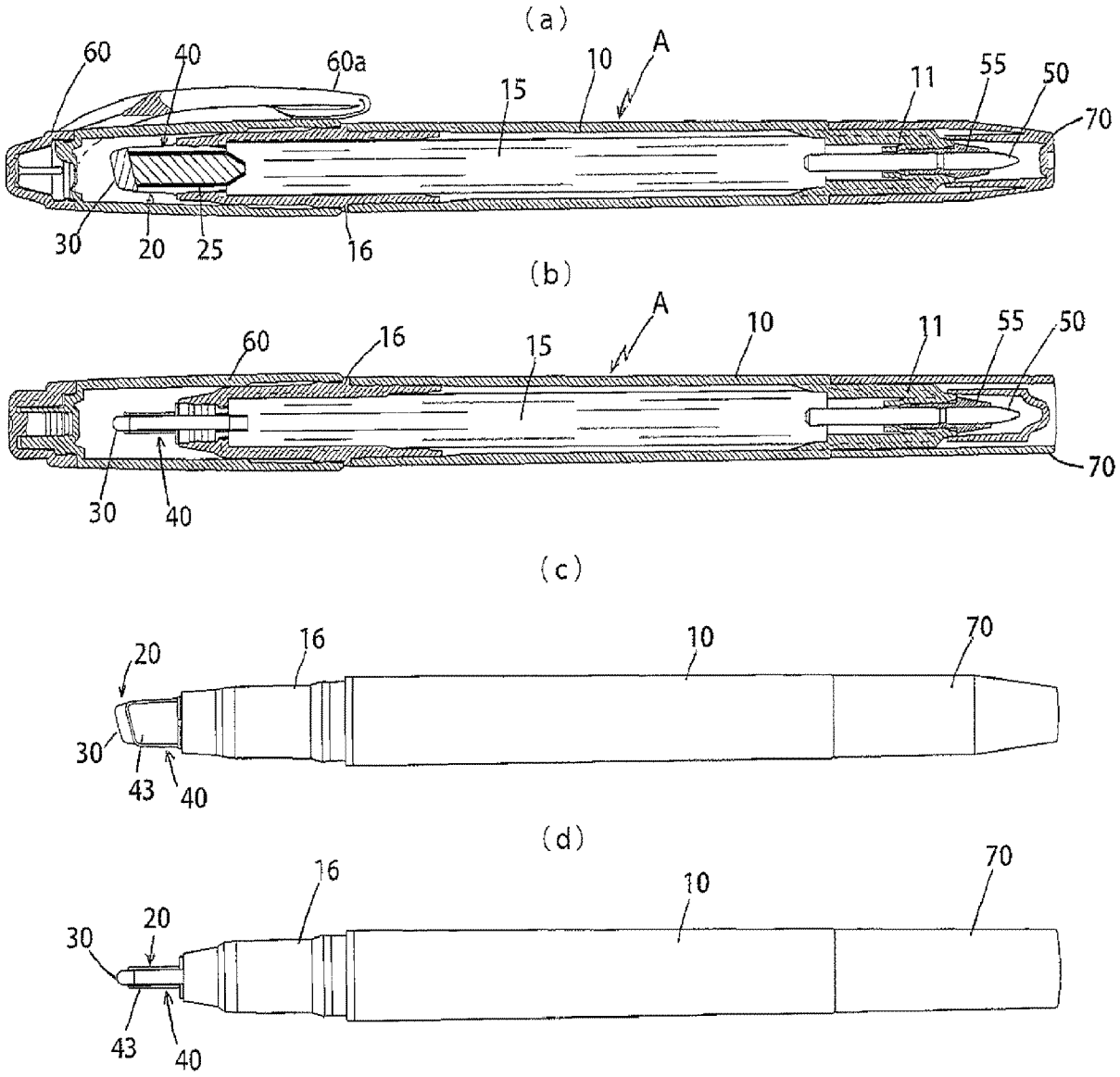
FIG. 1 Drawings showing an example of an embodiment of a twin-type writing implement of the present invention, (a) a vertical sectional view from the front, (b) a vertical sectional view from the top, (c) a front view with one cap removed, and (d) a plan view of (c).
Figure 2:
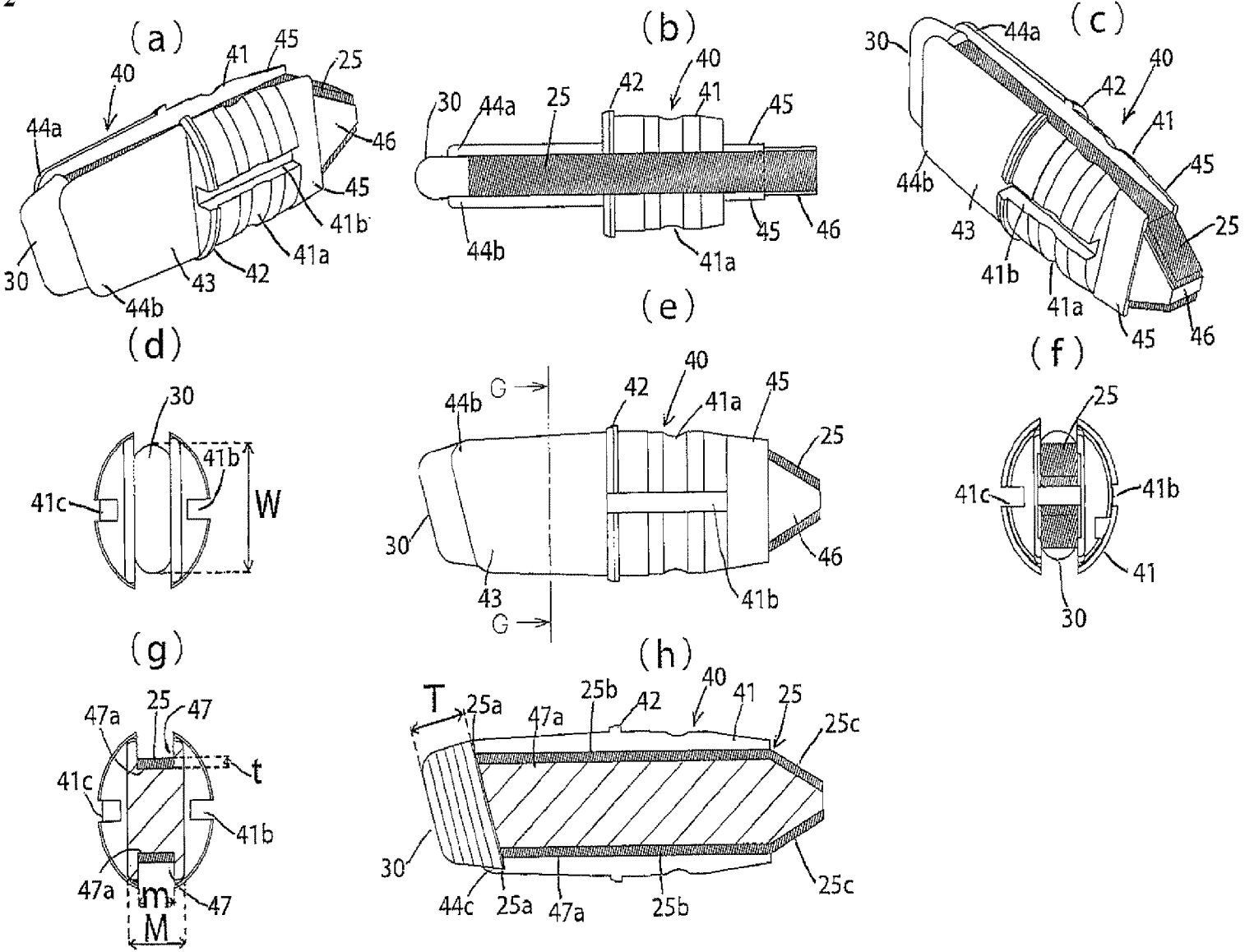
FIG. 2 Drawings showing an example of a pen tip used in a writing implement of the present invention, (a) a perspective view seen from the front side, (b) a plan view, and (c) a perspective view seen from the rear side, (d) a left side view, (e) a front view, (f) a right side view, (g) a vertical section cut on a line G-G in (e), and (h) a vertical section of (e) cut along the center line.

FIG. 1 includes drawings showing an example of an embodiment of a twin-type writing implement of the present invention. FIG. 2 includes drawings showing an example of a pen tip used in the writing implement of FIG. 1.

As shown in FIG. 1 (*a*) to (*d*), a writing implement A of the present embodiment is a twin-type writing implement that has a pen tip 20 feeding ink from a writing implement body 10 and having a viewer portion through which the writing direction can be seen and a rod-shaped pen tip 50 on the opposite side of the pen tip 20. Attached on both sides of the writing implement body 10 are a removable cap 60 having a clip 60*a* for protecting the pen tip 20 and a cap 70 for protecting the pen tip 50.

The writing implement body 10 is a cylindrical body made of, for example, a thermoplastic resin, a thermosetting resin, or the like, and contains the ink absorbent material 15 impregnated with an ink for writing implements, with a holder 11 having a fitting for fixing a holding piece 55 for holding the rod-shaped pen tip 50 of a fine type, arranged at one end on the right side and a front barrel 16 fixing the pen tip 20 having the viewer portion through which the writing direction can be seen, attached at the other end on the left side.

The writing implement body 10 is a cylindrical molding formed of a resin such as polypropylene or the like, and serves as a writing implement main body (barrel body). The writing implement body 10 is molded opaque or transparent (and translucent), but either may be adopted in view of appearance and practical use.

The ink absorbent material 15 is impregnated with an ink for writing implements such as water-based ink and oil-based ink, and its examples include a fiber bundle formed of one or a combination of natural fiber, animal hair fiber, polyacetal resin, acrylic resin, polyester resin, polyamide resin, polyurethane resin, polyolefin resin, polyvinyl resin, polycarbonate resin, polyether resin, polyphenylene resin, etc., a processed material of fiber bundles of felt etc., and/or porous materials such as sponges, resin particles, and sintered bodies. This ink absorbent material 15 is accommodated and held in the writing implement body 10.

The composition of the ink for writing implements to be used is not particularly limited, and may be suitably formulated as a compound of an aqueous ink, an oil-based ink, or a thermochromic ink, depending on the application of the writing implement; for example, for underliner pens and the like, fluorescent dyes such as Basic Violet 11, Basic Yellow 40, thermochromic microcapsule pigments, and the like can be formulated as content.

The ink is formulated by adjusting the kinds of ink ingredients and the compound ratio so as to present an ink viscosity (25° C.: cone/plate viscometer) of 1 to 5 mPa·s, a surface tension of 30 to 60 mN/m and so that the ink outflow X from the pen tip 20 falls in 5 to 20 mg/m, and the ink outflow Y from the pen tip 50 falls in 0.1 to 5 mg/m. Setting X greater than Y is preferable because this enables different traces of writing to be effectively produced. The ink outflow is measured by setting the pen on an automatic writing device and writing on high-quality paper at a writing angle of 65° and a writing force of 1 N with a writing speed of 7 cm/s, in accordance with JIS 56037.

When a thermochromic ink is used as the ink for writing implements, a plastic elastomer whose ability (erasure ratio) of erasing pencil drawn lines, defined in JIS S6050-2002 is equal to or lower than 70%, is formed on the top of the cap 60, whereby it is possible to provide a rubbing body that is easy to generate friction heat by rubbing and has low wear.

As shown in FIGS. 1(*a*) and 1(*b*) and FIGS. 2(*a*) to 2(*h*), the pen tip 20 is formed of at least a writing part 30 and a holding body 40 having a viewer portion. The holding body 40 is formed with a sheet-shaped ink feeder 25 which has slits or bumps on the surface and inside thereof to produce a capillary action.

The sheet-shaped ink feeder 25 is attached to the after-mentioned holding body 40 by means of adhesion, fusing, or a cover member.

The sheet-shaped ink feeder 25 is configured to have slits or bumps on the surface and inside thereof, and has a structure producing a capillary action.

Figure 3:
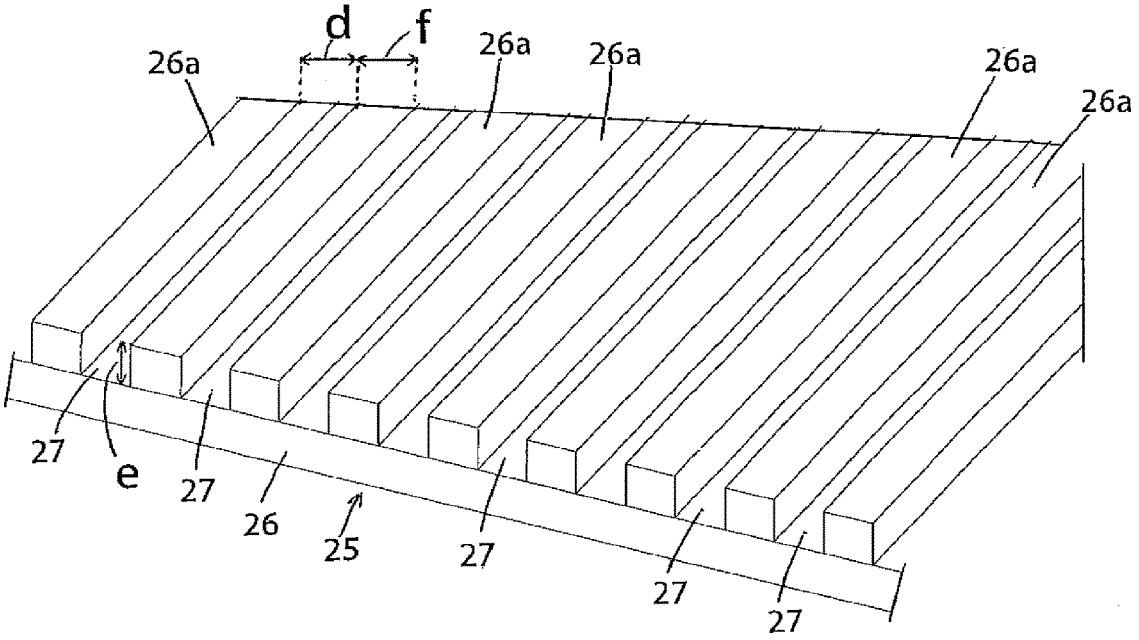
FIG. 3 Partial perspective views showing a surface texture of the sheet-shaped ink feeder of the pen tip used in the writing implement of the present invention, (a) a first example, and (b) a second example.
Figure 3:
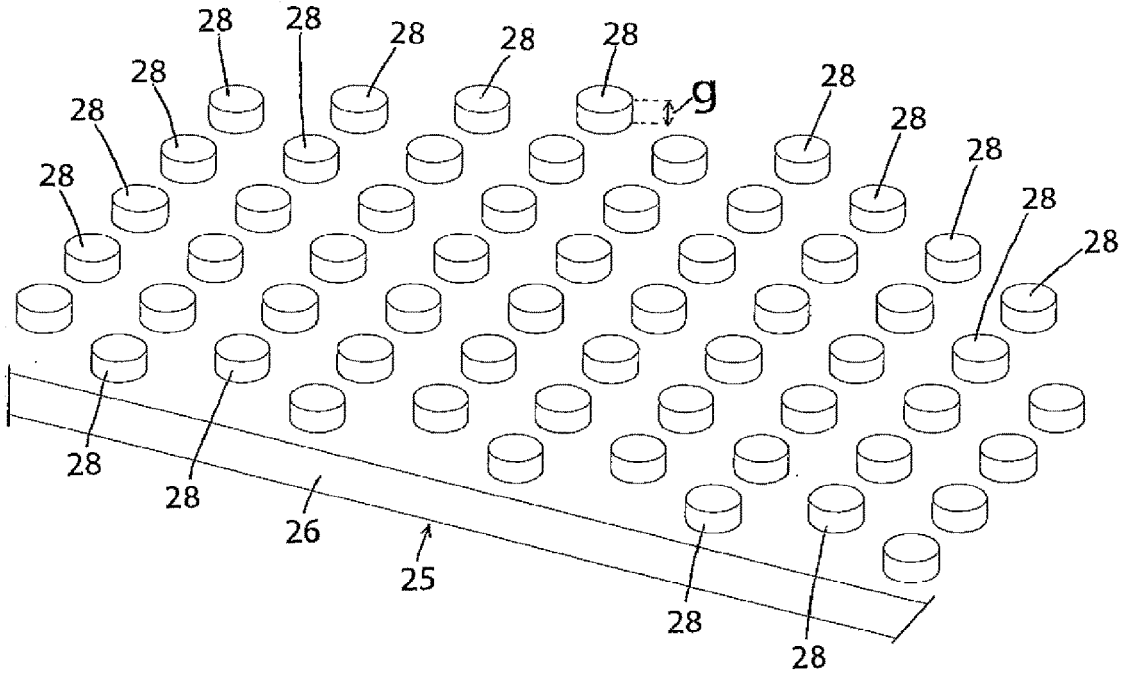

FIG. 3(*a*) shows a structure having a large number of slits (grooves) 27, 27 . . . on a substrate 26 of the sheet-shaped ink feeder 25 to produce a capillary action. The slits (grooves) 27, 27 . . . formed between the slit banks 26*a*, 26*a* extend linearly in the longitudinal direction and are arranged parallel to each other at predetermined intervals. The shape, dimensions, number, etc. of the slits 27, 27 . . . are not particularly limited as long as they form a structure producing a capillary action to be able to feed ink.

For example, the groove width d of each slit 27 is 10 to 100 μm, the depth (height) e may be the same or different from each other as long as they are within the range of 10 to 100 μm, and, and the interval f is 10 to 100 μm, and the sectional shape of the slit 27 may be rectangular U-shaped, U-shaped, V-shaped, stepped, or the like. In the present embodiment, rectangular U-shape is adopted.

FIG. 3(*b*) shows a structure having a number of bumps on a base material 26 of the sheet-shaped ink feeder 25. In the present embodiment, the columnar protrusions 28, 28 . . . are formed to produce a capillary action. The dimensions, number, cross-sectional area, etc. of the bumps are not particularly limited as long as they form a structure producing a capillary action to be able to feed ink. For example, the interval between the adjacent bumps 28, 28 . . . should at least fall in a range from 10 to 100 μm. The cross-sectional area should be in the range of 100 to 5000 $\mu m^2$ and the height g of the protrusion should be in the range of 10 to 100 μm. The height of the bumps may be the same or different from each other as long as within the range of 10 to 100 μm. The shape of the bumps may be a cylindrical shape, an elliptic cylindrical shape, a polygonal prism shape including a quadrangular prim shape and the like.

The method of forming the slit or bumps producing a capillary action on the base material of the sheet-shaped ink feeder 25 is not particularly limited as long as it can provide a structure producing a capillary action thanks to the configurations such as the aforementioned dimensions.

However, because precise micro fabrication is required, for example, a nano imprint method (thermal nano imprint method, nano imprint lithography method), a photolithographic etching method, an interference exposure method, a laser treatment method, or the like may be used.

In the thermal nano imprint method, desired slits or bumps are formed on the surface of the base material of the sheet-shaped ink feeder 25 by thermal deformation, i.e., by pressing a die against the surface while the surface is being heated. The die used is provided with an inverted concavo-convex pattern corresponding to the slits or bumps to be formed.

In the nano imprint lithography method, first, a photo curable resin is applied to the surface of the base material of the sheet-shaped ink feeder 25 to form a resin layer. Next, the resin layer is cured with a die pressed thereagainst by irradiating the resin with light. Since the die is formed with an inverted concavo-convex pattern corresponding to the slits or bumps to be formed, a resin-formed concavo-convex pattern of slits or bumps is formed after separating the die. Next, the surface of the base material is etched by using the resin-made concavo-convex pattern as a mask material, so that an array of slits or bumps can be formed on the surface of the base material of the sheet-shaped ink feeder 25.

In the photolithographic etching method, first, a photoresist is applied to the surface of the base material of the sheet-shaped ink feeder 25. Next, with the mask placed above the photoresist, the photoresist is irradiated with light to cause a photoreaction in the photoresist. Thereafter, excess photoresist is removed by a development process to obtain a photoresist pattern. Next, by using the photoresist pattern as a mask material, the surface of the base material is etched to form an array of slits or bumps on the surface of the base material.

When this photolithographic etching method is used, for example, a rolling mask lithography technique may be used. In this technique, a cylindrical roll mask can be used to form slits or bumps. This method has an advantage that minute slits or bumps can be easily formed over a large area.

Further, in the interference exposure method, first, photoresist is applied on the surface of the base material of the sheet-shaped ink feeder 25. Next, the photoresist is irradiated with laser light of two or more light waves simultaneously to cause optical interference on the photoresist. Thereafter, excess photoresist is removed by a development process to form a photoresist pattern. Then, by using the obtained photoresist pattern as a mask, the surface of the glass substrate is etched, whereby the slits or bumps can be formed on the surface of the base material of the sheet-shaped ink feeder 25.

The above-described methods of forming slits or bumps on the base material of the sheet-shaped ink feeder 25 are mere examples, and the slits or the bumps may be formed by any other methods.

For example, an excimer laser may be used to form slits or bumps having dimensions of the depth and width described above, on the surface of the base material.

As a preferable method for forming slits or bumps on the base material of the sheet-shaped ink feeder 25, the nano-imprint lithography method is desirable from the viewpoint of workability, efficiency, accuracy and others.

As the materials for the sheet-shaped ink feeder 25, thermoplastic resin, thermosetting resin, glass base materials, etc., may be listed. Examples include polyacetal resin, polyethylene resin, acrylic resin, polyester resin, polyamide resin, polyurethane resin, polyolefin resin, polyvinyl resin, polycarbonate resin, polyether resin, and polyphenylene resin.

The thickness, etc., of the sheet-shaped ink feeder 25 is determined by taking into account the mode of attachment to the holding body 40, enlargement of the see-through area of a viewer portion 43 and security of efficiency of ink flow (supply) to the writing part. Preferably, the dimension in the width direction and the dimension in the longitudinal direction, which are the width and the circumferential surface length of the holding groove surface, designated at 47*a* for fixing the ink feeder, are specified suitably so as to enable ink to flow efficiently to the writing part. The thickness t of the sheet-shaped ink feeder 25 is preferably 0.1 to 2.0 mm, and more preferably 0.2 to 1.0 mm from the viewpoint of enlarging the see-through area of the viewer portion 43. The width in is preferably 0.5 to 4.0 mm, and more preferably 1 to 3 mm.

The writing part 30 is formed of a porous body, one formed of a porous material having pores, and specific examples include sponge bodies, sintered bodies, and fiber bundle bodies, foams, sponges, felts, and porous bodies. Examples of the materials able to be used to form the porous body include natural fibers, animal hair fibers, polyacetal resin, polyethylene resin, acrylic resin, polyester resin, polyamide resin, polyurethane resin, polyolefin resin, polyvinyl resin, polycarbonate resin, polyether resin, polyphenylene resin and the like.

In this embodiment, a sintered body obtained by sintering various plastic powders is used.

The writing part 30 has an inclined shape (knife cut shape) so as to produce an inclination for easy writing, and the inclination and the like are appropriately set for writing convenience. Further, the writing part 30 draws a thick line width W, and the writing part is formed such that the drawing line width W is preferably 1 mm or more, and more preferably, 2 mm or more. In this writing part 30, the porosity is optimized so as to offer a suitable line density.

As shown in FIGS. 2(*a*) to 2(*h*), the holding body 40 fixes the above-described ink feeder 25 and writing part 30, and is fixed to the front end opening of the front barrel 16 of the writing implement body 10, and is formed of a rounded main body 41 and a flange 42 on the front side of the main body 41, the viewer portion (see-through portion) 43 through which the writing direction can be seen, further having holds 44*a*, 44*b* and an anti-removal retainer 44*c* for holding the front side (endface) of the writing part 30, formed on the front side of the viewer portion 43.

The main body 41 further includes, in the rear side thereof, a triangular rear portion 46 having holding pieces 45 connected to the main body 41. In view of enlarging the see-through area of the viewer portion 43, the holding body 40 thus formed of the above parts is formed with a structure arranged lengthwise along the whole peripheral surface inside the peripheral surface of the holding body 40. Specifically, a holding groove 47 for accommodating the sheet-shaped ink feeder 25 in a U-shape arrangement is formed lengthwise on the whole peripheral surface of the holding body 40. Formed in the width direction of the body portion 41 on the outer peripheral surface is a concave fitting portion 41*a*. On both the outer peripheral surfaces, a straight air circulation groove 41*b* and a bent air circulation groove 41*c* are formed in the longitudinal direction. Deployment of the sheet-shaped ink feeder 25 on the interior side of the outer peripheral surface of the holding body 40 makes it difficult for a hand and others to directly touch the sheet-shaped ink feeder 25. Therefore, it is possible to prevent ink from staining a ruler etc., during writing and suppress the influence on the ink outflow performance to the sheet-shaped ink feeder 25.

The entire holding body 40 thus configured is made of hard materials. For example, the hard materials having visibility are made of metal, glass and resin having no rubberlike elasticity. The holding body may be formed by molding with a material having a visible light transmittance of 50%, such as PP, PE, PET, PEN, nylon (including general nylon such as 6 nylon and 12 nylon, and amorphous nylon) and acryl, polymethylpentene, polystyrene, and ABS, as the resin allowing visual recognition and having no rubberlike elasticity, whereby the characters written in the writing direction can be seen through the viewer portion 43. Note that only the viewer portion 43 may be made of a material allowing visual recognition. The visible light transmittance can be determined by measuring the reflectance with a multi-light source spectrocolorimeter (manufactured by Suga Test Instruments Co., Ltd., (MSC-5N)). The holding body 40 may be made of one of the above materials, or may be made of two or more kinds of materials from the viewpoint of further improving durability and visibility, and can be molded by various molding methods such as injection molding, blow molding and the like.

As shown in FIG. 2(*h*) and others, the sheet-shaped ink feeder 25 is bonded to the mounting surface 47*a* of the U-shaped holding groove 47 of the holding body 40 by an adhesive, fusing or the like. The ink feeder 25 bonded to this holding body 40 is the writing part has a writing surface portion 25*a* that is the endface in contact with the proximal side of the writing part 30, flat surface portions 25*b* and 25*b* that supply ink to the writing part 30 side, and the inclined surface portions 25*c* and 25*c* that contact the ink absorbent material 15.

In the present embodiment, in view of increasing the see-through area of the viewer portion 43, the thickness t of the sheet-shaped ink feeder 25 is smaller than the thickness T of the writing part 30, and the width (m) of the ink feeder is preferably less than 90%, or more preferably 50 to 80%, of the width (M) of the viewer portion 43 of the holding body 40.

Figure 4:
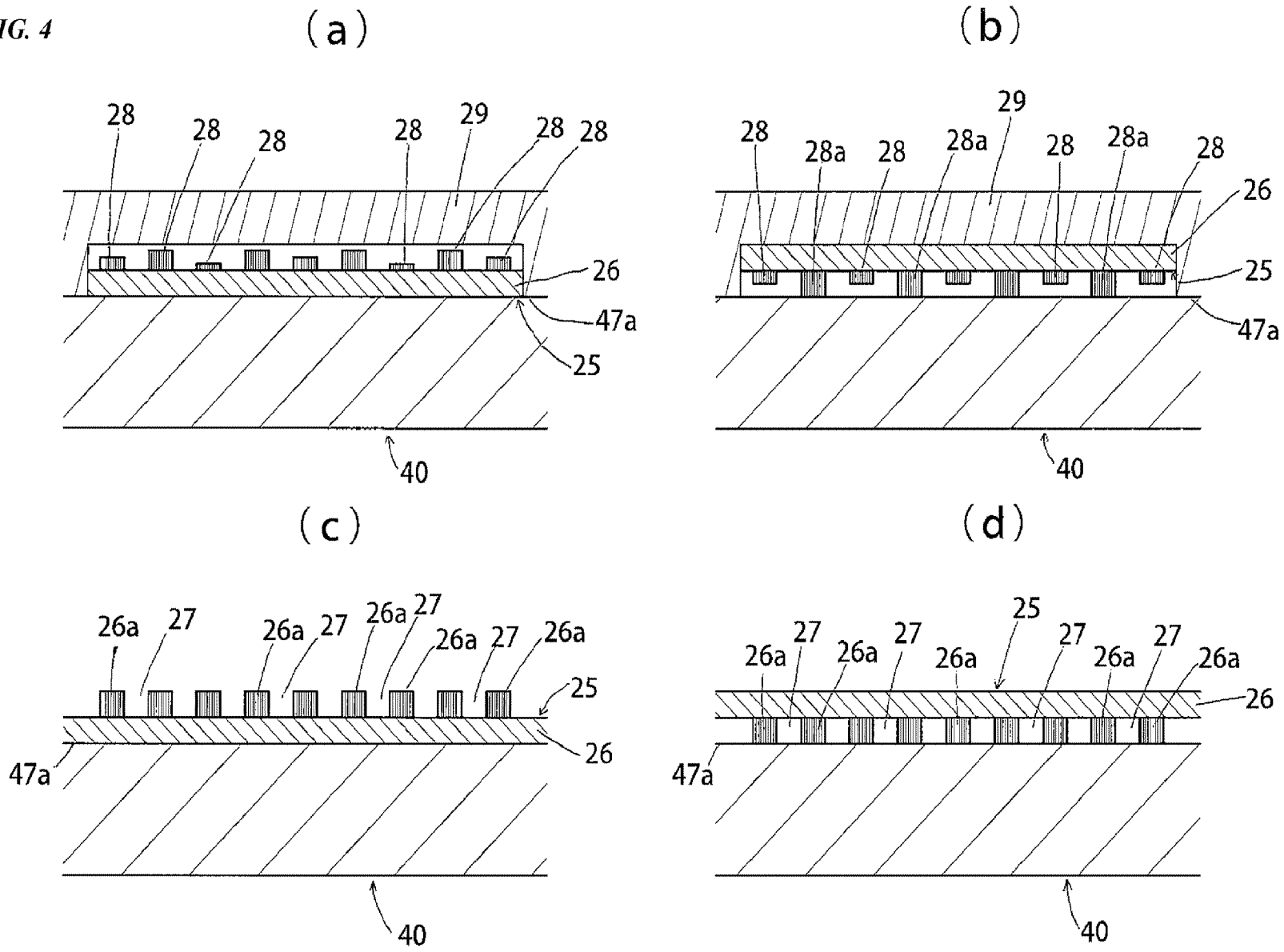
FIG. 4 (*a*) to (*d*), sectional views each showing a transverse sectional configuration of a different embodiment, in which a sheet-shaped ink feeder of a pen tip used in the writing implement of the present invention is formed in a holding body.

FIGS. 4(*a*) to 4(*d*) are sectional views showing, in profile section, different embodiments in which the sheet-shaped ink feeder 25 used in the present invention is formed on the holding body 40.

FIG. 4(*a*) shows a configuration in which a sheet-shaped ink feeder 25 having (e.g., cylindrical) bumps 28, 28 . . . (or slits) of different heights (depths) formed on the surface thereof by nanoimprinting is arranged on the holding body 40 with its base material 26 side set down and bonded to the holding groove mounting surface 47*a* while a cover material 29 is additionally provided for sealing (coverage) in order to minimize ink evaporation and the like, thus producing a capillary action thereinside.

FIG. 4(*b*) shows a configuration in which a sheet-shaped ink feeder 25 having (e.g., cylindrical) bumps 28 (or slits) of different heights (depths) formed on the surface thereof by nanoimprinting is arranged on the holding body 40 with its base material 26 side set up and the tops of the highest bumps 28*a* bonded to the holding groove mounting surface 47*a* while a cover material 29 is additionally provided for sealing (coverage) in order to minimize ink evaporation and the like, so that the clearances thereinside produce a capillary action.

As the cover material 29 used in FIGS. 4(*a*) and 4(*b*) above, the same material as that for the base member 26 of the sheet-shaped ink feeder 25 can be used. If this cover material 29 is provided to cover at least the flat surface portions 25*b* and 25*b* of the sheet-shaped ink feeder 25, the cover member for the inclined surface portions 25*c* and 25*c* are not required because the inclined surface portions 25*c* and 25*c* on the rear end side are inserted into the front side of the ink absorbent material 15 as shown in FIGS. 1(*a*) and 1(*b*). This promotes efficient ink flow from the ink absorbent material 15 into the inclined surface portions 25*c* and 25*c*. Since the cover material 29 is provided to minimize ink evaporation and the like, only the sheet-shaped ink feeder 25 of the present invention can efficiently supply ink from ink absorbent material 15 to the writing part 30 without provision of the cover material 29, as will be described with FIGS. 4(*c*) and 4(*d*).

FIG. 4(*c*) shows a configuration in which a sheet-shaped ink feeder 25 having slits 27, 27 . . . (or bumps) of the same depth (height) formed on the surface thereof by nanoimprinting is arranged on the holding body 40 with its base material 26 side set down and bonded to the holding groove mounting surface 47*a* forming the outside periphery of the holding body 40, so that the slits 27, 27 . . . produce a capillary action.

FIG. 4(*d*) shows a configuration in which a sheet-shaped ink feeder 25 having slits 27, 27 . . . (or bumps) of the same depth (height) formed on the surface thereof by nanoimprinting is arranged on the holding body 40 with its base material 26 side set up and the tops of the slit banks 26*a*, 26*a* bonded to the holding groove mounting surface 47*a* so that the slits 27, 27 . . . produce a capillary action.

In this writing implement A, fixing (attachment) of the writing part 30 to the holding body 40 may be additionally enhanced by boding with an adhesive or fusing in order to secure fitting and holding of the writing core 30 between the front holds 44*a* and 44*b* and the bonding (anti-falling) of the writing part 30. As shown in FIGS. 1 (*a*) and 1(*b*), the pen tip 50 is a rod-shaped tip of a fine type, and has a circular cross section. The rear end (ink absorbent material side) is inserted into the ink absorbent material 15 so that ink is supplied from the ink absorbent material 15 to the pen tip 50 by capillarity.

The pen tip 50 is made of a porous material, and its examples include a parallel fiber bundle formed of one or a combination of natural fiber, animal hair fiber, polyacetal resin, polyethylene resin, acrylic resin, polyester resin, polyamide resin, polyurethane resin, polyolefin resin, polyvinyl resin, polycarbonate resin, polyether resin, polyphenylene resin, etc., a fiber core obtained by processing a fiber bundle such as felt or processing these fiber bundles with resin, a porous body (sintered core) obtained by sintering a plastic powder of thermoplastic resin as polyolefin resin, acrylic resin, polyester resin, polyamide resin, polyurethane resin.

The pen tip 50 is preferably a fiber bundle core, a fiber core, a sintered core, a felt core, a sponge core, or an inorganic porous material core, and more preferably a fiber core from the viewpoint of deformation moldability and productivity. Also, the porosity, size, hardness, etc. of the pen tip 50 to be used varies depending on the ink type, the type of writing implement and others. The porosity is preferably set to 30 to 60%, for example. In the present invention, the "porosity" is calculated as follows. First, the writing core having a known mass and apparent volume is dipped in water, and saturated with water, and then the mass is measured in a state of being taken out from the water. From the measured mass, the volume of water soaked up in the writing core is derived. Assuming the volume of water as the pore volume of the writing core, the porosity can be calculated from the following formula:

$$\text{Porosity(unit:\%)} = (\text{water volume})/(\text{apparent volume of the pen tip 50}) \times 100.$$

In the writing implement A thus configured, the ink absorbent material 15 soaking up the ink is inserted and held in the writing implement body 10. The pen tip 20 having the above configuration is fixed on the front side by fitting via the front barrel 16 while the holding piece 55 having the pen tip 50 fixed therein is fixed on the other side by fitting, facilitating fabrication of the twin-type writing implement A. Ink absorbed in the ink absorbent material 15 is efficiently supplied via the sheet-shaped ink feeder 25 to the writing part 30 by capillary force in the tip 20 as well as to pen tip 50 and is used for writing.

With this writing implement A, since the pen tip 50 is the same as a conventional generic pen tip, the function of the pen tip 20 will be described below.

As shown in FIGS. 1 and 2, the pen tip 20 of this writing implement A has the viewer portion (window) 43 that allows visual recognition of the writing direction. By the capillary force of the sheet-shaped ink feeder 25, that is, by fixing the sheet-shaped ink feeder 25 (e.g., FIGS. 4(*a*) to 4(*d*)) having slits or bumps producing a capillary action, formed therein or thereon, on the mounting surface 47*a* of the holding body 40, ink in the ink absorbent material 15 flows in from the rear endface side of the sheet-shaped ink feeder 25 to the front endface to reach the writing part 30 and is used for writing. At the time of writing, if the user looks at the see-through side through the viewer part (window) 43, the user can easily place the pen tip at the starting position of the drawing, and stop the pen tip at a point desired to stop at the end of drawing to prevent excessive drawing or overshoot.

In the present invention, the pen tip 20 is configured to feed ink from the ink absorbent material 15 to the writing part 30 by the sheet-shaped ink feeder 25 that is thinner than the writing part 30 and has capillarity allowing outflow. Further, since this sheet-shaped ink feeder 25 is formed therein or thereon with fine slits 27, 27 . . . , or bumps 28, 28 . . . , a large area having capillary action is secured, thus, the capillary force can be strengthened. Besides the ink feeder can be formed extremely thin. Thus, this ink feeder can exhibit a good ink outflow performance without the need of making the ink feeder thicker, compared to a conventional integrally formed sintered body of an ink feeder and a writing part. As a result, the sheet-shaped ink feeder 25 will not obstruct the viewer portion 43, so that the user can draw a line by the writing part 30 while visually checking the writing direction through the viewer portion 43 when a line is drawn from left to right by a right-handed user. Further, enlargement of the effective area of the viewer portion relative to the entire pen tip and efficient supply of ink to the writing part 30 through the sheet-shaped ink feeder 25 having the above-described features, makes it possible to provide a writing implement that can achieve both an increase in the effective area of the viewer portion and excellent ink outflow performance.

Also, since this writing implement A has a good ink outflow performance, even if the pen tip 20 is moved at a high speed for writing, ink supply can follow well so that it is possible to provide a writing implement with which no blurring of writing trace occurs.

The writing implement of the present invention is not limited to the above-described embodiment and the like, and can be variously modified within the scope of not changing the technical idea of the present invention.

Though the above embodiments are of a twin-type writing implement, the pen tip 50 may be omitted (by forming the barrel body as a cylinder with a bottom) so as to provide a single-type writing implement having the pen tip 20. Also, the writing implement may be configured with the pen tip 20 of a click-type that is projected and retracted.

In each of the above-described embodiments of FIGS. 1 to 3 and 4, the cross section of the barrel body of the writing implement body is formed in a circular shape, but may be formed in a variant shape such as a triangular shape, a polygonal shape having four or more sides, or an elliptical shape. Also, the described examples use the pen tip 20 whose entire body is formed of transparent material, but the pen tip 40 may be given as a two-color molding configured such that at least the viewer portion 43 is formed of transparent material while the portion on the main body 41 side attached to the main body of the writing implement may be formed of a resin other than transparent material.

Further, in each of the above-described embodiments, ink for writing implements (water-based ink, oil-based ink, thermochromic ink) is used, but liquid materials such as liquid cosmetics, liquid medicines, coating liquids, and correction liquids may be used.

EXAMPLES

Next, the present invention will be described in more detail with reference to examples, but the present invention should not be limited to the following examples.

Example 1

A writing implement having a pen tip conforming to a structure as follows and FIGS. 1, 2, 3(*a*) and 4(*c*) was used with an ink for writing implements having the following composition. The dimensions of the pen tip used were those shown below.

(Configuration of Pen Tip 20)

Made of acrylic resin, having a visible light transmittance of 85% [the visible light transmittance was obtained by measuring the reflectance with a multi-light source spectrocolorimeter (MSC-5N) manufactured by Suga Test Instruments Co., Ltd.]

Viewer portion (window) 43 with a (square) size of 6 mm×6 mm×7 mm×6 mm

Viewer portion having a width M of 4 mm

Fabrication of Sheet-Shaped Ink Feeder 25:

Using a nanoimprinting method, a sheet-like ink feeder 25 having a capillary action with slits formed on the surface was prepared.

The obtained sheet-shaped ink feeder 25 had a width m of 3 mm and a thickness t of 0.5 mm. In observation of each slit 27 by an electron microscope, the groove width d was 50 μm, the spacing f was 50 μm, the depth (height) e was 50 μm, and the profile of the slit 27 was rectangularly intended.

Writing part 30: polyethylene sintered core, porosity 50%, axial height T=4 mm, core wall thickness H=3 mm (≒ width m), width W=6 mm.

Ink absorbent material 15: PET fiber bundle, porosity 85%, ϕ5×80 mm

Writing implement body 10, cap 60, 70: made of polypropylene (PP)

Pen tip 50: polyester fiber bundle core, porosity 60%, ϕ2.0×50.0 mm (Ink Composition for Writing Implements: Ink Color: Fluorescent Yellow)

As the ink for writing implements, the following ink composition (total 100% by mass) was used.

Moisturizer: trimethylglycine (glycine betaine) 7.5% by mass, pentaerythritol 4.5% by mass Coloring agent: NKW-4805 yellow (Nippon Keiko Kagaku Co., Ltd.) 40.0% by mass Preservative: Bioace (KI Chemical Industry Co. Ltd.) 0.3% by mass pH adjusting agent: triethanolamine 1.0% by mass Fluorosurfactant: SURFLON 8111N (AGC Seimi Chemical Co. Ltd.) 0.2% by mass Water-soluble organic solvent:

Ethylene glycol 3.0% by mass

Water (solvent): ion-exchanged water 43.5% by mass

Viscosity (25° C.): 3.0 mPa·s (cone/plate type viscometer, manufactured by TOKIMEC Co. Ltd., TV-20)

Surface tension (25° C.): 33 mN/m (automatic surface

Tension meter, Kyowa Interface Science Co. Ltd., DY-300)

In the writing implement using the pen tip 20 of Example 1 conforming to FIGS. 1 and 2, FIG. 3(*a*) and FIG. 4(*c*), ink is fed from the ink absorbent material 15 to the writing part 30 through the sheet-shaped ink feeder 25 that is thinner than the thickness of the writing part 30 and has a good outflow performance. Further, the sheet-shaped ink feeder 25 is formed with the slits 27, 27 . . . by a nanoimprinting method so as to produce a capillary action. Accordingly, the sheet-shaped ink feeder 25 could produce strong capillary force, and yet could be formed extremely thin to present better ink flowability than the conventional integration of an ink feeder and a writing part formed of a sintered body. Because the ink feeder does not need to be formed thick, the viewer part 43 was not obstructed by the sheet-shaped ink feeder 25. As a result, the user could draw a line by the writing part 30 while visually checking the writing direction through the viewer portion 43 when a line was drawn from left to right by a right-handed user. Further, the effective area of the viewer portion 43 relative to the entire pen tip could be enlarged and ink could be efficiently supplied to the writing part 30 through the sheet-shaped ink feeder 25 having the above-described features. Thus it could be confirmed to provide a writing implement that can achieve both an increase in the effective area of the viewer portion and excellent ink outflow performance. It was also confirmed that even after dropping the writing implement from a height of 1 m, writing could be performed without blurring.

Further, this writing implement was set in an automatic writing machine and tested in a method following JIS 56037. After writing a line on a quality paper surface at a writing angle of 65° applying a writing load of 1 N at a speed of 7 cm/s, the state of the drawn line was visually checked. As a result, with use of the above-described preferable ink composition, it was found that the pen tip could produce fine ink flow (15 mg/m), and that ink presented excellency in dryability of the drawn line and low-temperature stability while suppressing drying of the pen tip without causing blurring or strikethrough in the drawn line.

Example 2

A writing implement having a pen tip conforming to a structure as follows and FIGS. 1, 2, 3(*b*) and 4(*a*) was used with an ink for writing implements having the following composition. The dimensions of the pen tip used were those shown below.

(Configuration of Pen Tip 20)

The configuration of the writing implement is the same as that of the above embodiment except in that the sheet-shaped ink feeder 25 is specified as follows, so that the description will be omitted.

Writing implement body 10, ink absorbent material 15, writing part 30, holding body 40, ink composition and others: the same as those in the above Example 1.

Fabrication of Sheet-Shaped Ink Feeder 25:

Using a nanoimprinting method, a sheet-like ink feeder 25 having a capillary action with bumps formed on the surface was prepared.

The obtained sheet-shaped ink feeder 25 had a width m of 3 mm and a thickness t of 50 mm. The bumps were cylindrical pieces 28, 28 and in observation by an electron microscope, the bumps had a cross section of about 700 $\mu m^2$ and a height g of 50 μm and were distributed at intervals of 30 to 80 μm.

In the writing implement using this pen tip 20, the sheet-shaped ink feeder 25 of the pen tip 20 has a good outflow performance, is thinner than the thickness of the writing part 30 and feeds ink from the ink absorbent material 15 to the writing part 30 therethrough. Further, the sheet-shaped ink feeder 25 is formed with the bumps 28, 28 . . . by a nanoimprinting method so as to have a capillary action. Accordingly, the sheet-shaped ink feeder 25 can produce strong capillary force. Since the sheet-shaped ink feeder 25 is configured such that a fiber bundle is directly wound on and fixed to the peripheral side of the holding groove surface 47*a*, the feeder can produce a strong capillary force for its porosity because the fiber handle has a large surface area. And yet, the feeder can be formed extremely thin to present better ink flowability than the conventional integration of an ink feeder and a writing part formed of a sintered body. Because the ink feeder does not need to be formed thick, the viewer part 43 is not obstructed by the ink feeder formed of a sheet-shaped porous body. As a result, the user can draw a line by the writing part 30 while visually checking the writing direction through the viewer portion 43 when a line is drawn from left to right by a right-handed user. Further, enlargement of the effective area of the viewer portion relative to the entire pen tip and efficient supply of ink to the writing part 30 through the sheet-shaped ink feeder 25 having the above-described features, make it possible to provide a writing implement that can achieve both an increase in the effective area of the viewer portion and excellent ink outflow performance.

Also in this embodiment, since the ink outflow performance is fine, it is possible to obtain a writing implement that can sufficiently supply ink as consumed without producing any blurring in the writing trace when the writing the pen tip 20 is moved at high speeds.

Further, this writing implement was set in an automatic writing machine and tested in a method following JIS 56037. After writing a line on a quality paper surface at a writing angle of 65° applying a writing load of 1 N at a speed of 7 cm/s, the state of the drawn line was visually checked. As a result, with use of the above-described preferable ink composition, it was found that the pen tip could produce fine ink flow (15 mg/m), and that ink presented excellency in dryability of the drawn line and low-temperature stability while suppressing drying of the pen tip without causing blurring or strikethrough in the drawn line.

INDUSTRIAL APPLICABILITY

The pen tip of the present invention can be suitably applied as a pen tip used for marking type writing implements called an underline pens, paint markers, oil-based markers, and water-based markers.

DESCRIPTION OF REFERENCE NUMERALS

10*w* writing implement body
20 pen tip
25 sheet-shaped ink feeder
30 writing part 30
40 holding body
43 viewer portion

What is claimed is:

1. A writing implement comprising:

a pen tip feeding ink from a writing implement body and having a viewer portion through which a writing direction can be recognized, wherein the pen tip is configured of, at least, a writing part and a holding body having the viewer portion, wherein a surface of the holding body or an inside of the holding body has a sheet-shaped ink feeder, wherein slits or bumps are formed on a surface of the sheet-shaped ink feeder to produce a capillary action, and wherein the sheet-shaped ink feeder is arranged inside a peripheral end surface of the holding body.

2. The writing implement according to claim 1, wherein the slits or the interval between adjacent bumps formed in the sheet-shaped ink feeder has a width of 10 to 100 μm.

* * * * *